US007934329B2

(12) United States Patent
Mintah et al.

(10) Patent No.: US 7,934,329 B2
(45) Date of Patent: May 3, 2011

(54) SEMI-AUTONOMOUS EXCAVATION CONTROL SYSTEM

(75) Inventors: Brian Mintah, Washington, IL (US); Robert J. Price, Dunlap, IL (US); Kevin D. King, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 413 days.

(21) Appl. No.: 12/073,129

(22) Filed: Feb. 29, 2008

(65) Prior Publication Data

US 2009/0218112 A1 Sep. 3, 2009

(51) Int. Cl.
*G05D 1/02* (2006.01)

(52) U.S. Cl. ..... 37/348; 37/411; 37/414; 37/195; 414/699; 701/50

(58) Field of Classification Search ..... 37/348, 37/414, 411, 195; 414/699, 815; 701/50, 701/23, 25; 172/1, 2
See application file for complete search history.

(56) References Cited

U.S. PATENT DOCUMENTS

| | | | | |
|---|---|---|---|---|
| 3,643,828 | A * | 2/1972 | Elliott | 414/699 |
| 4,288,196 | A * | 9/1981 | Sutton, II | 414/699 |
| 4,377,043 | A * | 3/1983 | Inui et al. | 37/414 |
| 5,065,326 | A * | 11/1991 | Sahm | 701/50 |
| 5,446,980 | A * | 9/1995 | Rocke | 37/348 |
| 5,493,798 | A * | 2/1996 | Rocke et al. | 37/348 |
| 5,528,843 | A * | 6/1996 | Rocke | 37/348 |
| 5,572,809 | A * | 11/1996 | Steenwyk et al. | 37/348 |
| 5,682,312 | A * | 10/1997 | Rocke | 701/50 |
| 5,699,247 | A * | 12/1997 | Moriya et al. | 701/50 |
| 5,857,828 | A * | 1/1999 | Lee et al. | 414/815 |
| 5,899,008 | A * | 5/1999 | Cobo et al. | 37/348 |
| 5,924,493 | A * | 7/1999 | Hartman et al. | 172/4.5 |
| 5,933,346 | A * | 8/1999 | Brabec et al. | 700/61 |
| 6,076,030 | A * | 6/2000 | Rowe | 701/50 |
| 6,119,054 | A * | 9/2000 | Miki et al. | 700/275 |
| 6,247,538 | B1 * | 6/2001 | Takeda et al. | 172/2 |
| 6,266,901 | B1 * | 7/2001 | Kanda et al. | 37/403 |
| 6,363,632 | B1 * | 4/2002 | Stentz et al. | 37/414 |
| 6,604,305 | B2 * | 8/2003 | Koch | 37/348 |
| 6,691,010 | B1 * | 2/2004 | Gay | 701/50 |
| 6,736,216 | B2 * | 5/2004 | Savard et al. | 172/1 |
| 2005/0102866 | A1 * | 5/2005 | Sewell et al. | 37/411 |
| 2006/0074517 | A1 * | 4/2006 | Schneider et al. | 700/213 |
| 2008/0219820 | A1 * | 9/2008 | Kiegerl et al. | 414/469 |
| 2008/0257569 | A1 * | 10/2008 | Foster et al. | 172/9 |
| 2008/0257570 | A1 * | 10/2008 | Keplinger et al. | 172/9 |

FOREIGN PATENT DOCUMENTS

| | | |
|---|---|---|
| EP | 1146174 | 10/2001 |
| EP | 1526221 | 4/2005 |

* cited by examiner

*Primary Examiner* — Thomas A Beach
*Assistant Examiner* — Matthew R Buck
(74) *Attorney, Agent, or Firm* — Finnegan, Henderson, Farabow, Garrett & Dunner LLP

(57) ABSTRACT

An excavation control system for a machine is disclosed. The excavation control system may have a tool, at least one operator input device configured to provide manual control over movement of the tool, and a controller in communication with the at least one operator input device. The controller may be configured to receive an input related to an operator desired tool location, and determine that an operator is manually controlling movement of the tool toward the operator desired tool location. The controller may be further configured to automatically assume control over movement of the tool toward the operator desired tool location based on the determination.

27 Claims, 2 Drawing Sheets

SEMI-AUTONOMOUS EXCAVATION CONTROL SYSTEM

TECHNICAL FIELD

The present disclosure relates generally to an excavation control system, and more particularly, to a semi-autonomous excavation control system.

BACKGROUND

Control of an excavation machine can be a difficult task to perform productively and efficiently, without causing operator fatigue. Such control can require years of experience and a high level of skill that not all operators posses. In order to ensure optimum performance of an excavation machine, even with inexperienced or low-skill operators, auto-dig systems are commonly utilized. Auto-dig systems automate many of the repetitive operations normally performed by a human operator.

A typical cycle for an excavation machine includes a dig segment, a swing-to-truck segment, a dump segment, and a swing-to-trench segment. Some of these segments are best performed by an operator, while others can be performed autonomously to reduce the fatigue of the operator and/or to reduce the skill or experience level that an operator must posses. For example, the dig and dump segments are generally best performed by a human operator, while the swinging segments can be performed autonomously or semi-autonomously. In order for an auto-dig system to benefit an operator, actuation of the system should be simple and cause little interruption in the excavation cycle.

One example of an auto-dig system is disclosed in U.S. Pat. No. 4,377,043 (the '043 patent) issued to Inui et al. on Mar. 22, 1983. The '043 patent discloses a semi-automatic hydraulic excavator capable of automatically controlling arm and bucket angles when bringing a bucket back to an original excavation posture after completion of a dumping step. The semi-automatic hydraulic excavator includes a manual-auto change over switch. When this switch is activated after the dumping step has been completed, and when an operator is controlling a boom cylinder to return the bucket to an excavation location (i.e., to within a trench), an arm cylinder and a boom cylinder are automatically controlled to orient the bucket for the next digging step before the bucket reaches the excavation location. Thus, the boom cylinder (as well as a swing cylinder and a bucket opening cylinder) is manually controlled, while the bucket and arm cylinders are automatically controlled in response to movement of the boom cylinder. In this manner, manual control of the excavation machine is simplified.

Although the semi-automatic hydraulic excavator of the '043 patent may simplify manual control thereof, the benefit may be limited. That is, the operator may still be required to complete many tasks manually (e.g., boom lift and boom swing), even during the autonomous portion of the excavation cycle. And, because the operator must activate an additional switch during each cycle for the semi-autonomous control to be implemented, the excavation cycle may be periodically interrupted.

The disclosed control system is directed to overcoming one or more of the problems set forth above.

SUMMARY

One aspect of the present disclosure is directed to an excavation control system. The excavation control system may include a tool, at least one operator input device configured to provide manual control over movement of the tool, and a controller in communication with the at least one operator input device. The controller may be configured to receive an input related to an operator desired tool location, and determine that an operator is manually controlling movement of the tool toward the operator desired tool location. The controller may be further configured to automatically assume control over movement of the tool toward the operator desired tool location based on the determination.

Another aspect of the present disclosure is directed to a method of automatically moving a tool during an excavation cycle. The method may include receiving an input related to an operator desired tool location, and determining that an operator is manually controlling movement of the tool toward the operator desired tool location. The method may further include automatically assuming control over movement of the tool toward the operator desired tool location based on the determination, and relinquishing automatic control over movement of the tool to the operator after the tool has reached the operator desired tool location.

DETAILED DESCRIPTION

Figure 1:
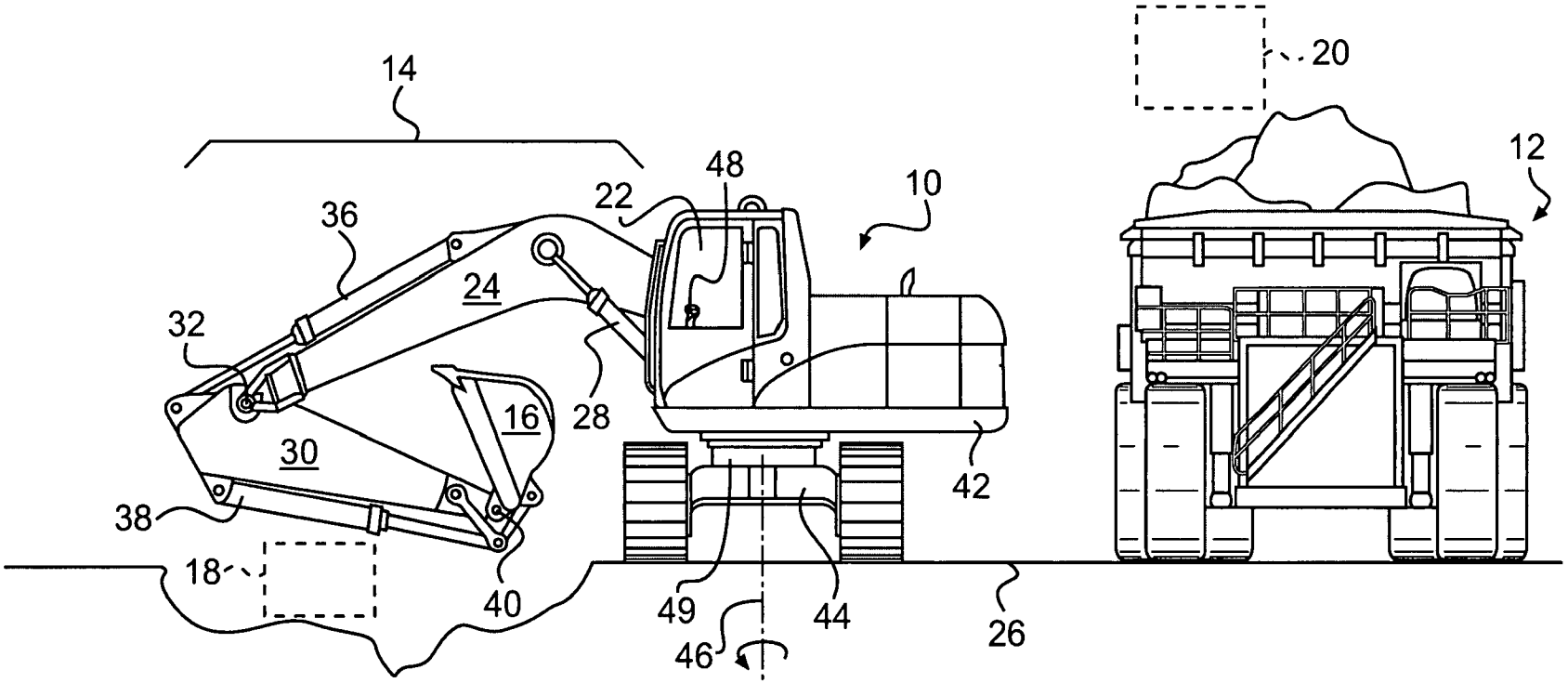
FIG. 1 is a diagrammatic illustration of an exemplary disclosed machine.

FIG. 1 illustrates an exemplary machine 10 having multiple systems and components that cooperate to excavate and load earthen material onto a nearby haul vehicle 12. In one example, machine 10 may embody a hydraulic excavator. It is contemplated, however, that machine 10 may embody another type of excavation machine such as a backhoe, a front shovel, a wheel loader, or another similar machine, if desired. Machine 10 may include, among other things, an implement system 14 configured to move a work tool 16 between a dig location 18 and a dump location 20 over haul vehicle 12, and an operator station 22 for manual control of implement system 14.

Implement system 14 may include a linkage structure acted on by fluid actuators to move work tool 16. Specifically, implement system 14 may include a boom member 24 vertically pivotal relative to a work surface 26 by a pair of adjacent, double-acting, hydraulic cylinders 28 (only one shown in FIG. 1). Implement system 14 may also include a stick member 30 vertically pivotal about a horizontal axis 32 by a single, double-acting, hydraulic cylinder 36. Implement system 14 may further include a single, double-acting, hydraulic cylinder 38 operatively connected to work tool 16 to pivot work tool 16 vertically about a horizontal pivot axis 40. Boom member 24 may be pivotally connected to a frame 42 of machine 10. Frame 42 may be pivotally connected to an undercarriage member 44, and moved about a vertical axis 46 by a swing motor 49. Stick member 30 may pivotally connect boom member 24 to work tool 16 by way of pivot axes 32 and 40. It is contemplated that a greater or lesser number of fluid actuators may be included within implement system 14 and connected in a manner other than described above, if desired.

Each of hydraulic cylinders 28, 36, 38 may include a tube and a piston assembly (not shown) arranged to form two separated pressure chambers. The pressure chambers may be selectively supplied with pressurized fluid and drained of the pressurized fluid to cause the piston assembly to displace within the tube, thereby changing an effective length of hydraulic cylinders 28, 36, 38. The flow rate of fluid into and out of the pressure chambers may relate to a speed of hydraulic cylinders 28, 36, 38, while a pressure differential between the two pressure chambers may relate to a force imparted by hydraulic cylinders 28, 36, 38 on the associated linkage members. The expansion and retraction of hydraulic cylinders 28, 36, 38 may function to assist in moving work tool 16.

Similar to hydraulic cylinders 28, 36, 38, swing motor 49 may be driven by a fluid pressure differential. Specifically, swing motor 49 may include a first and a second chamber (not shown) located to either side of an impeller (not shown). When the first chamber is filled with pressurized fluid and the second chamber is drained of fluid, the impeller may be urged to rotate in a first direction. Conversely, when the first chamber is drained of fluid and the second chamber is filled with pressurized fluid, the impeller may be urged to rotate in an opposite direction. The flow rate of fluid into and out of the first and second chambers may determine a rotational speed of swing motor 49, while a pressure differential across the impeller may determine an output torque thereof.

Numerous different work tools 16 may be attachable to a single machine 10 and controllable via operator station 22. Work tool 16 may include any device used to perform a particular task such as, for example, a bucket, a fork arrangement, a blade, a shovel, or any other task-performing device known in the art. Although connected in the embodiment of FIG. 1 to pivot relative to machine 10, work tool 16 may alternatively or additionally rotate, slide, swing, lift, or move in any other manner known in the art.

Operator station 22 may be configured to receive input from a machine operator indicative of a desired work tool movement. Specifically, operator station 22 may include one or more operator input devices 48 embodied as single or multi-axis joysticks located proximal an operator seat (not shown). Operator input devices 48 may be proportional-type controllers configured to position and/or orient work tool 16 by producing a work tool position signal that is indicative of a desired work tool speed and/or force in a particular direction. It is contemplated that different operator input devices may alternatively or additionally be included within operator station 22 such as, for example, wheels, knobs, push-pull devices, switches, pedals, and other operator input devices known in the art.

Figure 2:
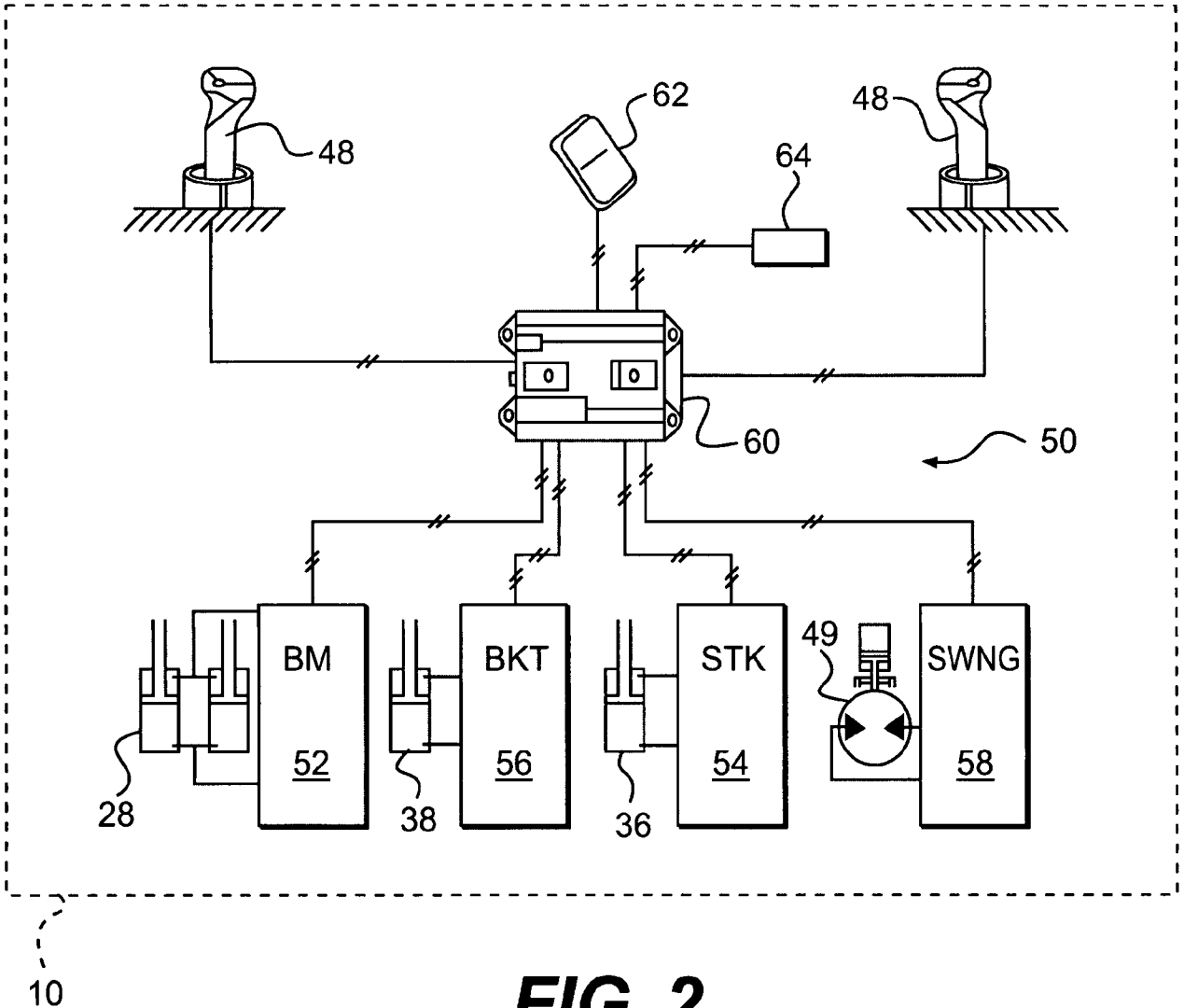
FIG. 2 is a schematic illustration of an exemplary disclosed control system that may be used with the machine of FIG. 1.

As illustrated in FIG. 2, machine 10 may include a hydraulic control system 50 having a plurality of fluid components that cooperate to move work tool 16 (referring to FIG. 1) in response to input received from operator input device 48. In particular, hydraulic control system 50 may include one or more fluid circuits (not shown) configured to produce and distribute streams of pressurized fluid. A boom control valve 52, a stick control valve 54, a bucket control valve 56, and a swing control valve 58 may be situated to receive the streams of pressurized fluid and selectively meter the fluid to and from hydraulic cylinders 28, 36, 38 and swing motor 49, respectively, to regulate the motions thereof. Specifically, boom control valve 52 may have elements movable in response to operator input to control the motion of hydraulic cylinders 28 associated with boom member 24; bucket control valve 56 may have elements movable to control the motion of hydraulic cylinder 38 associated with work tool 16; stick control valve 54 may have elements movable to control the motion of hydraulic cylinder 36 associated with stick member 30; and stick control valve 58 may have elements movable to control the swinging motion of frame 42.

Because the elements of boom, bucket, stick and swing control valves 52, 56, 54, and 58 may be similar and function in a related manner, only the operation of boom control valve 52 will be discussed in this disclosure. In one example, boom control valve 52 may include a first chamber supply element (not shown), a first chamber drain element (not shown), a second chamber supply element (not shown), and a second chamber drain element (not shown). To extend hydraulic cylinders 28, the first chamber supply element may be moved to allow the pressurized fluid to fill the first chambers of hydraulic cylinders 28 with pressurized fluid, while the second chamber drain element may be moved to drain fluid from the second chambers of hydraulic cylinders 28. To move hydraulic cylinders 28 in the opposite direction, the second chamber supply element may be moved to fill the second chambers of hydraulic cylinders 28 with pressurized fluid, while the first chamber drain element may be moved to drain fluid from the first chambers of hydraulic cylinders 28. It is contemplated that both the supply and drain functions may alternatively be performed by a single element associated with the first chamber and a single element associated with the second chamber, or by a single valve that controls all filling and draining functions, if desired.

The supply and drain elements may be solenoid movable against a spring bias in response to a command. In particular, hydraulic cylinders 28, 36, and 38 and swing motor 49 may move at a speed that corresponds to the flow rate of fluid into and out of the first and second chambers, and with a force that corresponds with a pressure of the fluid. To achieve an operator-desired speed and/or force indicated via the input device position signal, a command based on an assumed or measured pressure may be sent to the solenoids (not shown) of the supply and drain elements that causes them to open an amount corresponding to the necessary flow rate. The command may be in the form of a flow rate command or a valve element position command. It is also contemplated that the supply and drain elements may alternatively be pilot operated, if desired.

Hydraulic control system 50 may also include a controller 60 in communication with operator input device 48 to command the movements of the supply and drain elements described above. Controller 60 may embody a single microprocessor or multiple microprocessors that include a means for controlling an operation of hydraulic control system 50. Numerous commercially available microprocessors can be configured to perform the functions of controller 60. It should be appreciated that controller 60 could readily be embodied in a general machine microprocessor capable of controlling numerous machine functions. Controller 60 may include a memory, a secondary storage device, a processor, and any other components for running an application. Various other circuits may be associated with controller 60 such as power supply circuitry, signal conditioning circuitry, solenoid driver circuitry, and other types of circuitry.

One or more maps relating the input device position signal, desired actuator speed or force, associated flow rates and pressures, and/or valve element positions associated with movement of hydraulic cylinders 28, 36, and 38 and swing motor 49 may be stored in the memory of controller 60. Each of these maps may include a collection of data in the form of tables, graphs, and/or equations. In one example, desired speed and commanded flow rate may form the coordinate axis of a 2-D table for control of the first and second chamber supply elements described above. The commanded flow rate required to move the fluid actuators at the desired speed and the corresponding valve element position of the appropriate supply element may be related in another separate 2-D map or together with desired speed in a single 3-D map. It is also contemplated that desired actuator speed may be directly related to the valve element position in a single 2-D map.

Controller 60 may be configured to allow the operator of machine 10 to directly modify these maps and/or to select specific maps from available relationship maps stored in the memory of controller 60 to affect fluid actuator motion. It is contemplated that the maps may additionally or alternatively be automatically selectable based on modes of machine operation, if desired.

Controller 60 may be configured to receive input from operator input device 48 and to command operation of control valves 52, 54, 56, and 58 in response to the input and based on the relationship maps described above. Specifically, controller 60 may receive the input device position signal indicative of a desired speed and/or force, and reference the selected and/or modified relationship maps stored in the memory of controller 60 to determine flow rate values and/or associated positions for each of the supply and drain elements within control valves 52, 54, 56, and 58. The flow rates or positions may then be commanded of the appropriate supply and drain elements to cause filling of the first or second chambers at a rate that results in the desired work tool movement.

In some situations, it may be desirable for movements of work tool 16 to be controlled autonomously. For example, during the typical excavation cycle (dig, swing-to-truck, dump, swing-to-trench), after an operator completes a segment of the cycle requiring manually control, controller 60 may assume full control of valves 52, 54, 56, and 58 to complete one or more autonomous segments of the cycle. In one embodiment, the dig and dump segments may be manually completed, while the swinging segments (i.e., the swing-to-truck and/or the swing-to-trench segments) may be autonomously completed. To initiate autonomous control, the operator may be provided with a switch 62.

Switch 62 may be used to indicate a desire for autonomous control during a portion of the excavation cycle. That is, when the operator activates switch 62 at the start of a work shift, controller 60 may assume autonomous control during the swinging segments of each excavation cycle thereafter until switch 62 has been deactivated. In this manner, once the operator has completed a manual segment of the cycle, controller 60 may automatically control the operation of valves 52, 54, 56, and 58 without further intervention by the operator or interruption of the excavation cycle. After completion of the swinging segments, controller 60 may automatically relinquish control back to the operator.

Controller 60 may determine that the manual segments of the excavation cycle have been completed when specific operational parameters of machine 10 substantially match one or more threshold values. In one example, the operational parameters may be related to a speed and/or a movement direction of hydraulic cylinders 28 and/or swing motor 49. That is, when an operator has completed the dig segment of the excavation cycle, the operator may begin the swing-to-truck segment as if the autonomous control did not exist. As such, the operator may move operator input device 48 to pivot boom member 24 upward away from dig location 18, and start swinging work tool 16 horizontally toward dump location 20 over waiting haul vehicle 12. And, when the associated upward extending speed of hydraulic cylinders 28 exceeds a first threshold speed, and when the speed of swing motor 49 exceeds a second threshold speed, controller 60 may conclude that the manual segment of the excavation cycle has been completed and seamlessly complete the swing-to-truck segment in response thereto. In one example, the first threshold speed may be substantially constant between excavation cycles. Specifically, the angular speed may be about 5°/sec. The second threshold speed may vary between excavation cycles, and be based on a maximum swing speed achieved during a previously completed swing-to-truck segment. Specifically, the second threshold speed may be a percent of the maximum swing speed, for example, about 20%. Thus, when boom member 24 is pivoting at a speed of 5°/sec or more, and is simultaneously swinging at 20% or more of the previous maximum swing speed, controller 60 may assume control of valves 52, 54, 56, and 58 and complete the swing-to-truck segment. The swing-to-truck segment may be completed when work tool 16 enters dump location 20 over haul vehicle 12.

Controller 60 may assume control over the movement of work tool 16 at a location that is different for each swing-to-truck segment. That is, because controller 60 may assume control based only on speeds, the location at which controller 60 assumes control may always be different. For example, if the operator quickly displaces input device 48 to a high speed position immediately after completing the dig segment, boom member 24 may immediately be accelerated beyond the required speed thresholds. As a result, controller 60 may assume control very near where digging has occurred. In contrast, if the operator slowly displaces input device 48 to the high speed position, hydraulic cylinders 28 and/or swing motor 49 may accelerate boom member 24 slowly. As a result, controller 60 may assume control closer to dump location 20. It is contemplated that, in some situations, the operator may not displace input device 48 enough to increase the lift and swing speeds of boom member 24 beyond the threshold speeds during the swing-to-truck segment. In these situations, autonomous completion may never occur (i.e., the swing-to-truck segment may be completed manually).

Controller 60 may relinquish control over movement of work tool 16 at about the same location for each excavation cycle. That is, controller 60 may relinquish control as soon as work tool 16 has reached the previously defined dump location 20, regardless of speed. Thus, regardless of whether autonomous control began near dig location 18 or near dump location 20, autonomous control may be relinquished as soon as work tool 16 crosses a virtual boundary into dump location 20.

Dump location 20 may be a virtual 3-D region defined by an operator. Dump location 20 may be programmed into the memory of controller 60 during operation of machine 10, selected from a list of available locations, and/or taught to controller 60 during operation of machine 10. To teach controller 60, the operator of machine 10 may position and/or orient work tool 16 at the desired dump location 20, and then activate as switch (e.g., switch 62 or another similar switch located within operator station 22) to indicate the current location is the desired dump location 20. Controller 60 may then record the current location, as well as a general region around the current location, as the desired dump location 20. The size of the general region may be pre-programmed into the memory of controller 60 or defined by the operator, if desired.

The swing-to-trench segment of the excavation cycle may be autonomously completed in a manner similar to the swing-to-truck segment, but triggered based on different operational parameters. That is, after the operator of machine 10 has completed the dump segment, the operator may begin to swing work tool 16 away from haul vehicle 12 and toward dig location 18. Once the operational parameters of machine 10 substantially match one or more threshold values, controller 60 may conclude that the manual segment has been completed, and seamlessly assume control over valves 52, 54, 56, and 58 to complete the subsequent swing-to-trench segment. In one example, the threshold values for the swing-to-trench segment may be associated with a swing speed and a boom movement direction. That is, as long as boom member 24 is lowering toward work surface 26 and the swing speed exceeds about 20% of the maximum swing speed during the previous swing-to-trench segment, controller 60 may autonomously complete the current swing-to-trench segment, regardless of boom speed. Boom speed may not be considered during the swing-to-trench segment, as typical operators generally swing away from haul vehicle 12 before lowering boom member 24 at a significant speed. Thus, as long as boom member 24 is pivoting downward (regardless of the speed), and the swing speed thereof exceeds the threshold value, autonomous completion of the segment may be triggered.

Similar to the swing-to-truck segment, controller 60 may assume control over movement of work tool 16 during the swing-to-trench segment at different locations. That is, because controller 60 may assume control based only on a boom movement direction and a swing speed, the location at which controller 60 assumes control may always be different.

Controller 60 may relinquish control over the movement of work tool 16 at about the same location for each swing-to-trench segment. That is, controller 60 may relinquish control as soon as work tool 16 has entered dig location 18. Thus, regardless of whether autonomous control began near dump location 20 or near dig location 18, autonomous control may be relinquished as soon as work tool 16 crosses a virtual boundary into dig location 18.

Dig location 18 may be a virtual 3-D region defined by an operator. Dig location 18 may be programmed into the memory of controller 60 during operation of machine 10, selected from a list of available locations, and/or taught to controller 60 during operation of machine 10. To teach controller 60, the operator of machine 10 may position and/or orient work tool 16 at the desired location, and then activate a switch (e.g., switch 62 or another similar switch located within operator station 22) to indicate the current location is the desired dig location 18. Controller 60 may then record the current location, as well as a general region around the current location, as the desired dig location 18. The size of the general region may be pre-programmed into the memory of controller 60 or defined by the operator, if desired.

When controller 60 assumes control over the movement of work tool 16, it may move work tool 16 to the desired dig and/or dump locations 18, 20 at maximum speed and in a smooth continuous manner. The maximum speed may be a maximum speed capable by the components of implement system 14, or a speed defined by the operator of machine 10. In order to accomplish the smooth continuous movement, controller 60 may be required to define a curvilinear trajectory between the location at which autonomous control is assumed and the end tool location (i.e., the dig or dump location 18, 20). Controller 60 may then simultaneously control any number of hydraulic cylinders 28, 36, 38 and/or swing motor 58 such that work tool 16 moves along the trajectory. In this manner, work tool 16 may be moved from the assumed location to the end location as quickly and efficiently as possible.

Hydraulic control system 50 may be equipped with one or more sensory elements 64 necessary for the control of machine 10. In one example, the sensory elements 64 may be position sensors associated with each of hydraulic cylinders 28, 38, 36 and/or swing motor 49. In another example, the sensor elements may be angle sensors associated with the pivot joints of implement system 14. In yet another example, the sensory elements 64 may be local and/or global position sensors configured to communicate with offboard devices (e.g., local laser systems, radar systems, satellites, etc.) to determine local and/or global coordinates of work tool 16. Based on signals generated from sensory elements 64 and based on known kinematics of machine 10, controller 60 may be configured to control valves 52, 54, 56, and 58 to position work tool 16 relative to the operator defined dig and dump locations 18, 20. In addition, based on the signals generated by sensory elements 64, controller 60 may be able to derive and record velocities and accelerations of implement system 14, if desired. Thus, although commonly termed as a boom speed, controller 60 may assume autonomous control based on a measured or derived linkage member speed, actuator speed, or tool speed.

INDUSTRIAL APPLICABILITY

The disclosed hydraulic control system may be applicable to any excavation machine that benefits from semi-autonomous control. The disclosed hydraulic control system may assume control of an excavation machine when it has recognized that a manual operation is complete, and relinquish control back to the operator when the machine's tool has been moved to a desired end location where another manual operation is to be performed. The operation of hydraulic control system 50 will now be explained.

During operation of machine 10, a machine operator may define two spaced apart end locations for work tool 16. For example, the operator may define a desired dig location 18 and a desired dump location 20. It should be noted that, after a period of time, the operator may need to redefine these locations to account for material that has been removed from dig location 18 and for movement of machine 10 about an excavation area. After defining the dig and dump locations 18, 20, the operator may activate autonomous control by toggling switch 62.

Once switch 62 has been toggled to an autonomous control position, the operator may manipulate input device 48 to manually excavate material at the dig location and, thereby, complete the dig segment of the excavation cycle. Once work tool 16 is sufficiently filled with material, the operator may move input device 48 to initiate lifting and swinging of boom member 24 toward dump location 20. As boom member 24 pivots upward away from dig location 18 at about 5°/sec or more, and swings relative to undercarriage member 44 at about 20% of a maximum speed attained during a previous swing-to-truck segment, controller 60 may determine that the operator is moving work tool 16 toward a desired end location (i.e., controller 60 may conclude that manual control is complete), and assume control over the movement of work tool 16 to complete the swing-to-truck segment.

Once work tool 16 has reached dump location 20, controller 60 may relinquish control to the operator. The operator may then complete the dump segment of the excavation cycle and begin swinging work tool 16 back toward dig location 18. As the operator swings boom member 24 away from haul vehicle 12 at a speed that exceeds the threshold speed, and lowers work tool 16 toward surface 26, controller 60 may again assume control and complete the swing-to-trench segment of the excavation cycle. Once work tool 16 has reached dig location 18, controller 60 may again relinquish control to the operator in preparation for the next excavation cycle.

Several benefits may be associated with the disclosed excavation control system. First, because controller 60 may complete nearly all of the tasks associated with the swinging segments of the excavation cycle, the efforts expended by the operator may be minimal. As a result, the operator may fatigue less, and have more focus for the manual operations. Second, because the autonomous control may be so seamless, the excavation cycle may be substantially uninterrupted. In fact, use of the autonomous control may become a standard part of each cycle, without the operator even noticing that segments thereof are being completed autonomously.

It will be apparent to those skilled in the art that various modifications and variations can be made to the disclosed excavation control system. Other embodiments will be apparent to those skilled in the art from consideration of the specification and practice of the disclosed excavation control system. For example, it is contemplated that hydraulic cylinder position information (i.e., extension and/or retraction positions) and/or tool location (i.e., within dig location 18, within dump location 20, or somewhere therebetween) may be used in conjunction with the boom lift and swing velocity to determine when automated control may be assumed, if desired. It is intended that the specification and examples be considered as exemplary only, with a true scope being indicated by the following claims and their equivalents.

What is claimed is:

1. An excavation control system, comprising:

a tool;

at least one operator input device configured to provide manual control over movement of the tool;

a controller in communication with the at least one operator input device and being configured to:

receive an input related to an operator desired tool location, determine that an operator is in the process of manually controlling movement of the tool toward the operator desired tool location, and automatically assume control over movement of the tool toward the operator desired tool location based on the determination that the operator is in the process of manually controlling movement of the tool toward the operator desired location;

at least one linkage member connected to the tool; and at least one actuator controllable by the operator input device to move the tool, wherein the controller determines that the operator is manually controlling movement of the tool toward the desired tool location when a speed of the at least one actuator exceeds a threshold speed.

2. The excavation control system of claim 1, wherein the controller is configured to move the tool toward the desired tool location at a maximum speed.

3. The excavation control system of claim 1, wherein the controller is configured to move the tool toward the desired tool location in a smooth continuous trajectory.

4. The excavation control system of claim 1, wherein the controller is configured to relinquish automatic control over movement of the tool to the operator after the tool has reached the operator desired tool location.

5. The excavation control system of claim 1, wherein a location at which automatic control is assumed is different between excavation cycles.

6. The excavation control system of claim 1, wherein:

the at least one actuator includes a first actuator configured to pivot the at least one linkage member in a first direction, and a second actuator configured to swing the at least one linkage member in a second direction; and the controller determines that the operator is manually controlling movement of the tool toward the desired tool location when a pivot speed of the first actuator in a first direction exceeds a first threshold speed and a swing speed of the second actuator exceeds a second threshold speed.

7. The excavation control system of claim 6, wherein:

the first threshold speed remains constant between excavation cycles; and the second threshold speed varies based on a maximum swing speed achieved during a previous excavation cycle.

8. The excavation control system of claim 7, wherein the second threshold speed is a percent of the maximum swing speed achieved during the previous excavation cycle.

9. The excavation control system of claim 6, wherein:

the at least one linkage member is a boom;

the excavation control system further includes:

a stick member connecting the tool to the boom;

a stick actuator configured to move the stick member relative to the boom; and a tool actuator configured to move the tool relative to the stick; and the controller is configured to automatically assume control over the first actuator, the second actuator, the stick actuator, and the tool actuator when the pivot speed of the first actuator exceeds the first threshold speed and the swing speed of the second actuator exceeds the second threshold speed.

10. The excavation control system of claim 6, wherein the desired tool location is a dump location.

11. The excavation control system of claim 10, wherein the controller is further configured to:

receive an input related to an operator desired dig location;

determine that an operator is manually controlling movement of the tool toward the operator desired dig location; and automatically assume control over movement of the tool toward the operator desired dig location based on the determination.

12. The excavation control system of claim 11, wherein the controller determines that an operator is manually controlling movement of the tool toward the operator desired dig location based on a pivot direction of the first actuator and the swing speed of the second actuator exceeding the second threshold speed.

13. The excavation control system of claim 1, wherein the controller determines that an operator is manually controlling movement of the tool toward the operator desired to location further based on a position of the tool.

14. The excavation control system of claim 1, wherein the controller determines that the operator is manually controlling movement of the tool toward the desired tool location further based on an extension position of the at least one actuator.

15. A method of automatically moving a tool during an excavation cycle, the method comprising:

receiving an input related to an operator desired tool location;

determining that an operator is in the process of manually controlling movement of the tool toward the operator desired tool location;

automatically assuming control over movement of the tool toward the operator desired tool location for only a swing segment of the excavation cycle, based on the determination that the operator is in the process of manually controlling movement of the tool toward the operator desired location; and relinquishing automatic control over movement of the tool to the operator after the tool has reached the operator desired tool location.

16. The method of claim 15, wherein automatically assuming control includes moving the tool toward the desired tool location at a maximum speed and in a smooth continuous trajectory.

17. The method of claim 15, wherein a location at which automatic control is assumed is different between excavation cycles.

18. The method of claim 15, wherein determining includes detecting a pivot speed of the tool in a first direction exceeding a first threshold speed and a swing speed of the tool exceeding a second threshold speed, wherein the first threshold speed remains constant between excavation cycles, and the second threshold speed varies based on a maximum swing speed achieved during a previous excavation cycle.

19. The method of claim 18, wherein automatically assuming control over movement of the tool includes assuming control over movement of the tool in both the pivot direction and a swing direction.

20. The method of claim 18, further including:

receiving an input related to an operator desired dig location;

determining that an operator is manually controlling movement of the tool toward the operator desired dig location; and automatically assuming control over movement of the tool toward the operator desired dig location based on the determination, wherein determining that an operator is manually controlling movement of the tool toward the operator desired dig location is based only on a pivot direction of the tool and the swing speed of the tool.

21. A machine, comprising:

a frame;

a boom member connected to the frame;

a first boom actuator configured to pivot the boom member relative to the frame;

a second boom actuator configured to swing the boom member relative to the frame;

a tool operatively connected to the boom member;

at least one operator input device configured to provide manual control over movement of the tool; and a controller in communication with the at least one operator input device and being configured to:

receive an input related to an operator desired tool location;

determine that an operator is in the process of manually controlling movement of the tool toward the operator desired tool location when an operational parameter indicative of movement of the tool reaches a threshold;

automatically assume control over movement of the tool toward the operator desired tool location based on the determination that the operator is in the process of manually controlling movement of the tool toward the operator desired tool location; and relinquish automatic control over movement of the tool to the operator after the tool has reached the operator desired tool location.

22. An excavation control system, comprising:

a tool;

at least one operator input device configured to provide manual control over movement of the tool;

a controller in communication with the at least one operator input device and being configured to:

receive an input related to an operator desired tool location, determine that an operator is in the process of manually controlling movement of the tool toward the operator desired tool location, automatically assume control over movement of the tool toward the operator desired tool location based on the determination that the operator is in the process of manually controlling movement of the tool toward the operator desired location, and relinquish automatic control over movement of the tool to the operator after the tool has reached the operator desired tool location.

23. The excavation control system of claim 22, wherein the controller is configured to move the tool toward the desired tool location at a maximum speed.

24. The excavation control system of claim 22, wherein the controller is configured to move the tool toward the desired tool location in a smooth continuous trajectory.

25. The excavation control system of claim 22, wherein a location at which automatic control is assumed is different between excavation cycles.

26. The excavation control system of claim 22, wherein the controller determines that an operator is manually controlling movement of the tool toward the operator desired tool location based on a position of the tool.

27. The excavation control system of claim 22, further including at least one actuator controllable by the operator input device to move the tool, wherein the controller determines that the operator is manually controlling movement of the tool toward the desired tool location based on an extension position of the at least one actuator.

* * * * *